US006892401B1

(12) United States Patent
Mangum

(10) Patent No.: US 6,892,401 B1
(45) Date of Patent: May 17, 2005

(54) COMPRESSED AIR TOOL

(76) Inventor: Thomas E. Mangum, 3731 SW. 3rd Ave., Cape Coral, FL (US) 33914

( * ) Notice: Subject to any disclaimer, the term of this patent is extended or adjusted under 35 U.S.C. 154(b) by 1 day.

(21) Appl. No.: 10/428,483

(22) Filed: May 5, 2003

(51) Int. Cl.[7] ..... E03D 9/00
(52) U.S. Cl. ..... 4/255.06; 4/255.04
(58) Field of Search ..... 4/255.04, 255.05, 4/255.06, 255.07, 255.08, 255.09; 137/587; 417/308

(56) References Cited

U.S. PATENT DOCUMENTS

| | | | | |
|---|---|---|---|---|
| 669,819 | A * | 3/1901 | Brooks | 137/587 X |
| 1,994,526 | A * | 3/1935 | McCloskey | 4/255.06 |
| 2,059,785 | A | 11/1936 | Gaik | |
| 2,380,884 | A * | 7/1945 | Osborne et al. | 137/587 X |
| 2,635,628 | A * | 4/1953 | Stamper | 137/587 X |
| 4,063,317 | A * | 12/1977 | Santore | 4/255.06 X |
| 5,530,988 | A | 7/1996 | McQuillan | |
| D404,178 | S | 1/1999 | Wetzler | |
| 5,940,897 | A | 8/1999 | James | |
| 6,032,301 | A | 3/2000 | Wang | |
| 6,434,760 | B1 | 8/2002 | Montalvo | |

OTHER PUBLICATIONS

The American Heritage Dictionary, p. 1336.*
Website page printout from www.siemag.net/shfdp.htm, 1 pg.*
Website page printout from www.missvickie.com/library/2ndgeneration.html, 2 pgs.*

* cited by examiner

*Primary Examiner*—Robert M. Fetsuga

(57) ABSTRACT

A compressed air tool for unclogging drains includes an air chamber for storing compressed air. A one-way air inlet is fluidly coupled to the air chamber. An outlet valve selectively allows compressed air from the air chamber to enter a tube fluidly coupled to the air chamber. A free end of the tube may be positioned in the drain. A first check valve and a second check valve are each fluidly coupled to the air chamber and are each positionable in a retracted position or an extended position. Both of the first and second check valves are biased in the retracted position. The first check valve is urged into the extended position when compressed air positioned in the air chamber is equal to a first pressure. The second check valve is urged into the extended position when compressed air positioned in the air chamber is at least 10 psi greater than the first pressure.

10 Claims, 5 Drawing Sheets

COMPRESSED AIR TOOL

BACKGROUND OF THE INVENTION

1. Field of the Invention

The present invention relates to compressed air devices and more particularly pertains to a new compressed air device for unclogging drains using pressured air which is injected into the drain.

2. Description of the Prior Art

The use of compressed air devices is known in the prior art. While these devices fulfill their respective, particular objectives and requirements, the need remains for a device that uses pressurized air in a simple and safe method compared to previous designs.

SUMMARY OF THE INVENTION

The present invention meets the needs presented above by including first and second check valves. The first check valve indicates to the user that the compressed air within the air chamber has reached an effective pressure for unclogging a drain. The second check valve ensures that the user does not over-pressurize the compressed air within the air chamber.

Another object of the present invention is to provide a new compressed air device that includes guide bars to ensure that users to do not use the device to launch projectiles.

To this end, the present invention generally comprises an air chamber for releasably storing compressed air. The chamber includes an air inlet fluidly coupled thereto for selectively receiving compressed air. The air inlet comprises a one-way air inlet. An outlet valve is fluidly coupled to the air chamber. The outlet valve is selectively positioned in a closed position for retaining compressed air within the air chamber or an open position for releasing compressed air from the air chamber. A tube is fluidly coupled to the air chamber such that compressed air stored within the air chamber is released into the tube when the outlet valve is placed in the open position. The tube has an open free end. A first check valve is fluidly coupled to the air chamber. The first check valve is positionable in a retracted position or an extended position. The first check valve is biased in the retracted position. The first check valve is urged into the extended position when compressed air positioned in the air chamber is generally equal to a first pressure. A second check valve is fluidly coupled to the air chamber. The second check valve is positionable in a retracted position or an extended position. The second check valve is biased in the retracted position. The second check valve is urged into the extended position when compressed air positioned in the air chamber is at least 10 psi greater than the first pressure.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
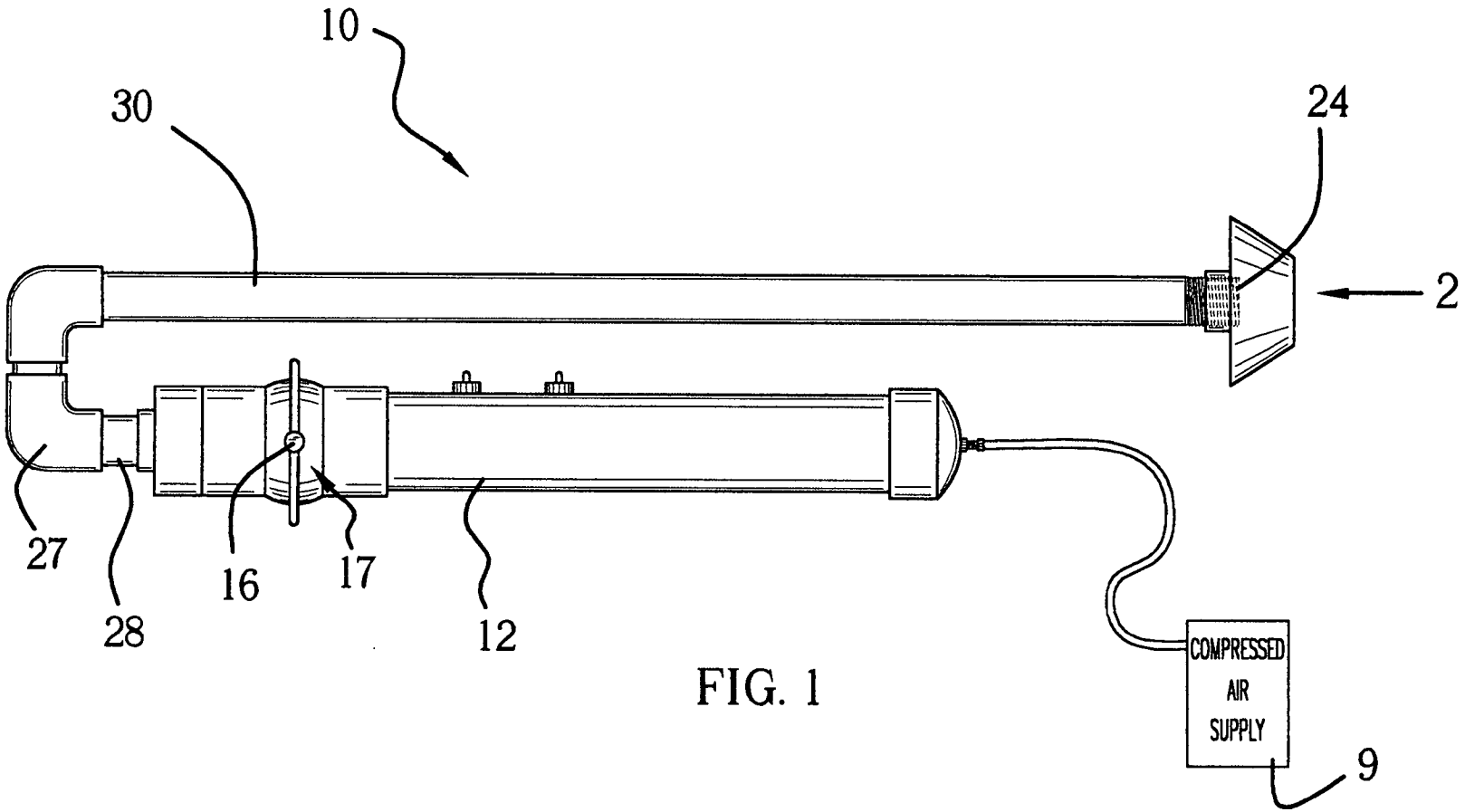
FIG. 1 is a schematic side view of a compressed air tool according to the present invention.
Figure 2:
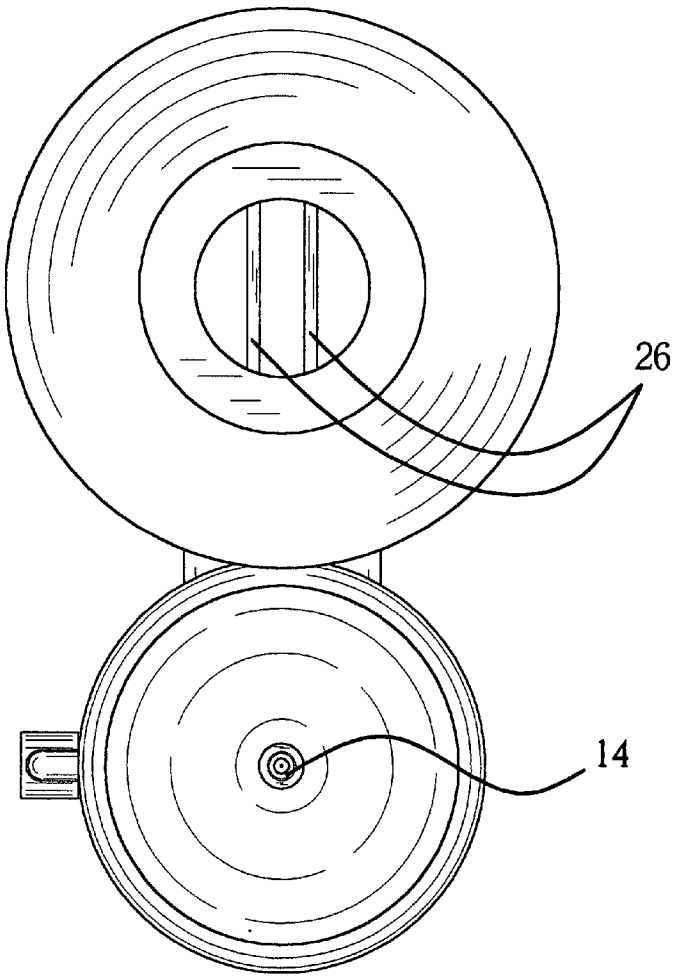
FIG. 2 is a schematic end view of the present invention taken along line "2" of FIG. 1.
Figure 3:
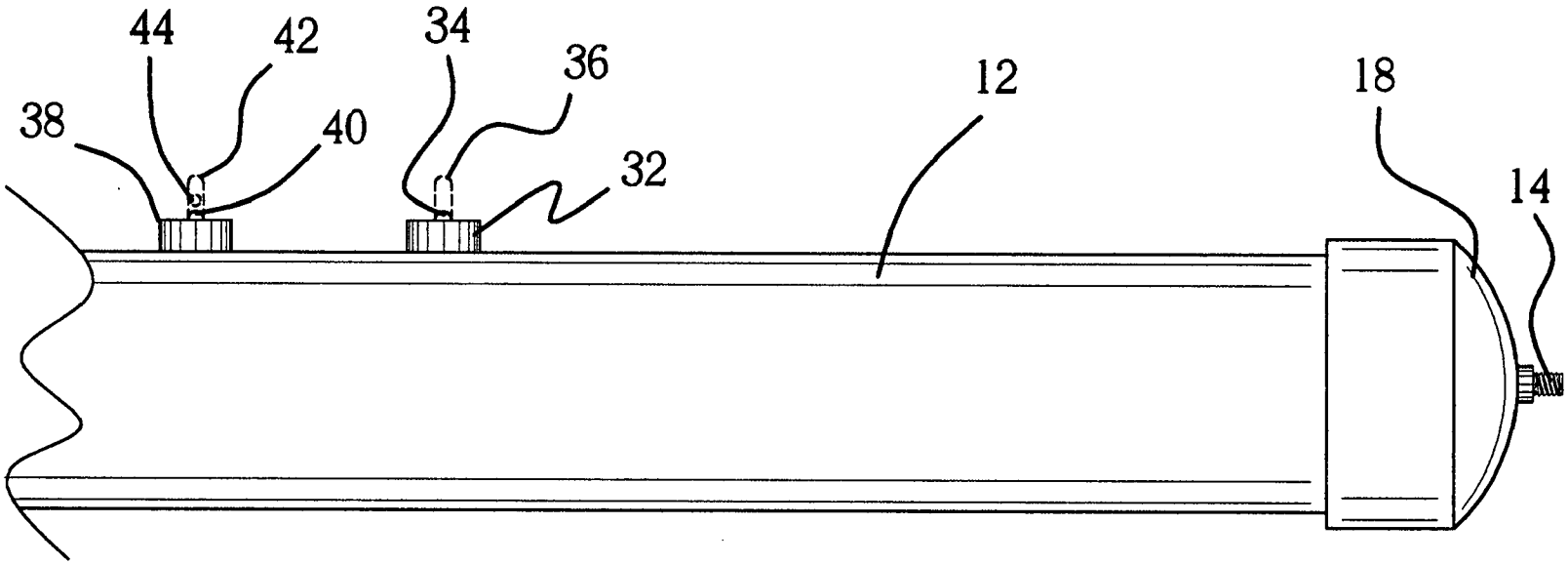
FIG. 3 is a schematic side view of the present invention.

With reference now to the drawings, and in particular to FIGS. 1 through 5 thereof, a new compressed air device embodying the principles and concepts of the present invention and generally designated by the reference numeral 10 will be described.

As best illustrated in FIGS. 1 through 5, the compressed air tool 10 generally comprises an air chamber 12 for releasably storing compressed air. An air inlet 14 is fluidly coupled to the air chamber 12. The air inlet 14 comprises a conventional one-way air inlet. An outlet valve 16 is fluidly coupled to the air chamber 12. The outlet valve 16 is selectively positioned in a closed position 17 for retaining compressed air within the air chamber 12 or an open position 19 for releasing compressed air from the air chamber 12. The air chamber 12 is preferably elongated and has a first end 18 a second 20 end. Preferably, the air inlet 14 is positioned on the first end 18 and the outlet valve 16 is positioned generally adjacent to the second end 20.

A tube 22 is fluidly coupled to the air chamber 12 such that compressed air stored within the air chamber 12 is released into the tube 22 when the outlet valve 16 is placed in the open position 19. The tube 22 is attached to the second end 20 of the air chamber 12. The tube 22 has an open free end 24. The tube 22 is threaded at a position adjacent to the free end 24. At least two guide bars 26 are positioned within the tube 22 and mounted generally adjacent to the free end 24. The guide bars 26 prevent a person from inserting an object into the free end 24 of the tube 22 and then shooting the object out of the tube 22 using the compressed air positioned in the air chamber 12. The tube 22 has a 180 degree bend 27 therein such that a first portion 28 and a second portion 30 of the tube 22 are defined. The first portion 28 is attached to the air chamber 12. A combined length of the first portion 28 and the air chamber 12 is shorter than a length of the second portion 30. Ideally, the second portion 30 is at least 6 inches longer than the combined length of the first portion 28 and the air chamber 12.

A first check valve 32 is fluidly coupled to the air chamber 12. The first check valve 32 is positionable in a retracted position 34 or an extended 36 position. The first check valve 32 is biased in the retracted position 34. The first check valve 32 is urged into the extended position 36 when compressed air positioned in the air chamber 12 is equal to a first air pressure. The first air pressure is preferably greater than 30 psi, more preferably greater than 50 psi and ideally greater than 70 psi. A second check valve 38 is also fluidly coupled to the air chamber. The second check valve 38 is positionable in a retracted position 40 or an extended position 42. The second check valve 38 is biased in the retracted position 40. The second check valve 38 is urged into the extended position 42 when compressed air positioned in the air chamber 12 is at least 10 psi greater than the first air pressure. Ideally, the second check valve 38 will move to the extended position 42 when the air pressure is greater than 90 psi. The second check valve 38 includes an air outlet 44 fluidly coupled to the air chamber 12. The air outlet 44 is opened to release compressed air outwardly of the air chamber 12 when the second check valve 38 is in the extended position.

Both of the first 32 and second 38 check valves are preferably conventional pop-up pressure indicating valves using springs or other mechanical biasing means to keep them in their retracted positions. Examples of such valves may be found on the internet at www.siemag.net/shfdp.htm and at www.missvickie.com/library/2ndgeneration.html. The first check valve 32 lets the user know that the enough compressed air is positioned within the air chamber 12 to make the tool effective for plunging a drain 6. The second check valve 38 ensures that the user does not compressed air above a certain pressure which may damage the drain 6. The air outlet 44 prevents the pressure of the compressed air from exceeding much greater than 90 psi. Thus, preferably, at 91 psi, the second check valve 38 will extend to release air and then retract when the pressure returns to 90 psi.

Figure 4:
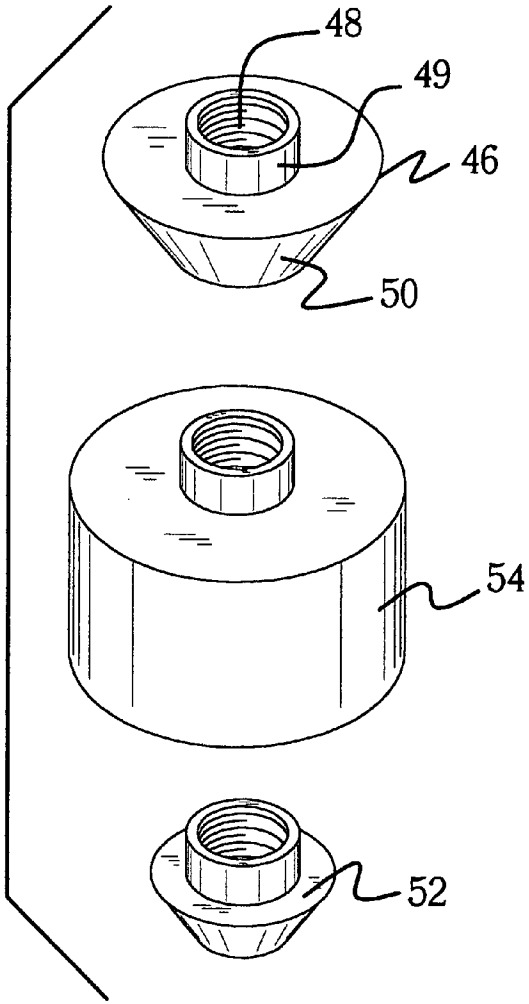
FIG. 4 is a schematic perspective view of adapters of the present invention.
Figure 5:
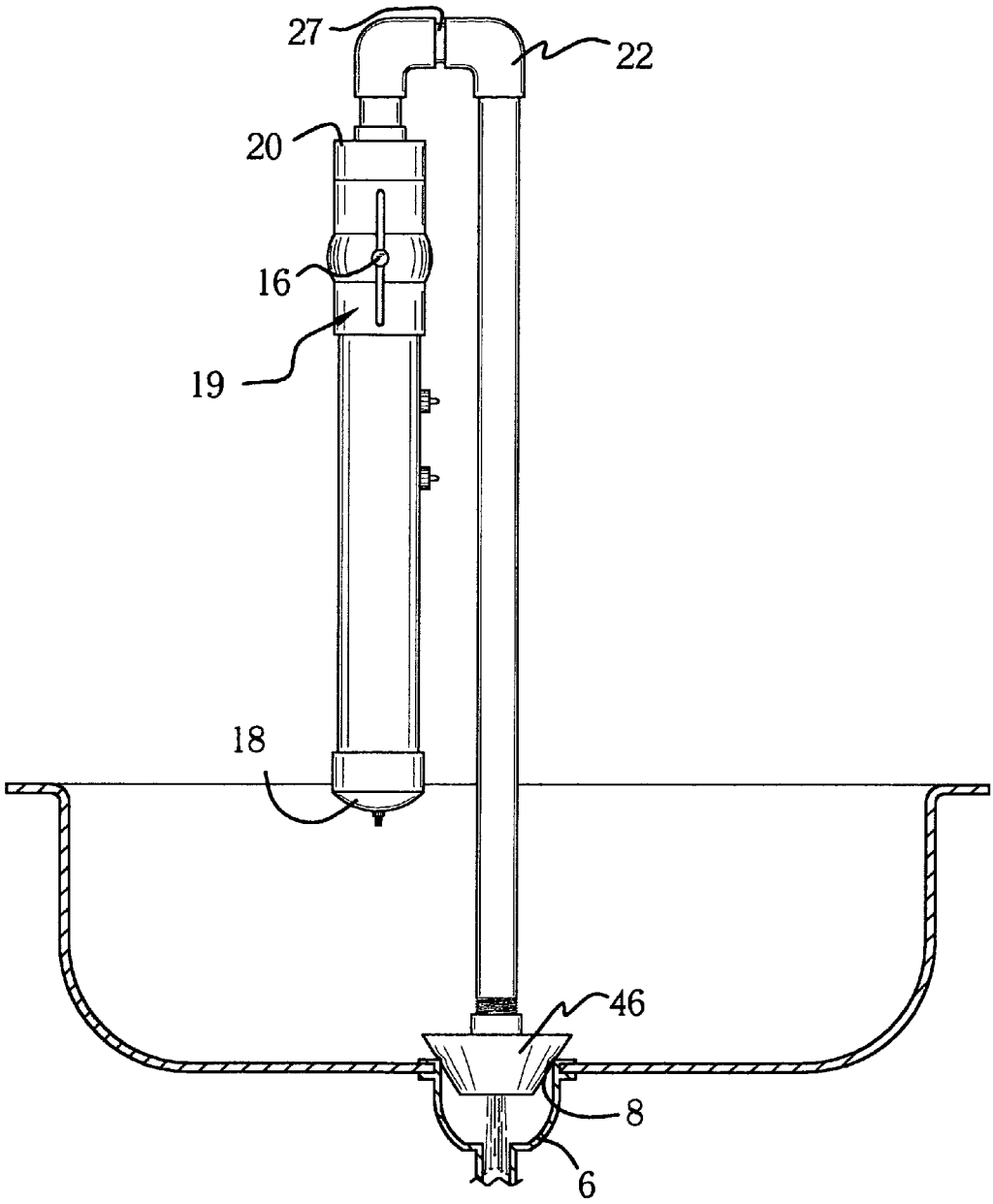
FIG. 5 is a schematic side ir-use view of the present invention.

At least one adapter 46 is selectively threadably coupled to the free end 24 of the tube 22. The adapter 46 has a threaded opening 48 extending therethrough. The opening 48 is threaded for selectively coupling to the threads on the tube 24. The adapter 46 comprises an elastomeric material. One version of the adapter 46 includes a sleeve 49 and is attached to a base of a frusto-conical section 50. The opening 48 extends through the sleeve 49 and the frusto-conical section 50. The sleeve 49 is adapted for receiving the free end 24 of the tube 22. The frusto conical section 50 may be positioned in a drain 6, as depicted in FIG. 5. The shape allows it to form a seal around an opening 8 of the drain 6. Additional adapters 52 are depicted in FIG. 4 and include size variations in the frusto-conical section 50 and a cylindrically shaped adapter 54. The user selects the adapter based on the intended use.

In use, the air inlet 14, which is preferably threaded, is attached to a compressed air source 9 which may include any conventional air source such as a hand help pump or compressed air canister. Additional variations are contemplated in which a hand pump is permanently attached to the air chamber. The user fills the air chamber 12 until the first check valve 32 moves to the extended position. If the second check valve 38 extends, it will release air until it retracts to indicate the proper amount of air is in the air chamber 12. The user places the adapter 46 on the free end 24 of the tube 22 and then places the adapter 46 into the opening 8 of the drain 6. The user may use the bend 27 as leverage for pushing downward on the tube 22. The outlet valve 16 is then opened to force air into the drain 6 to unclog the drain. The tool 10 may be used for all types of drains including toilets.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A compressed air plunger tool, said tool comprising:

an air chamber for releasably storing compressed air, said air chamber including an air inlet fluidly coupled thereto for selectively receiving compressed air, said air inlet comprising a one-way air inlet, an outlet valve being fluidly coupled to said air chamber, said outlet valve being selectively positioned in a closed position for retaining compressed air within said air chamber or an open position for releasing compressed air from said air chamber;

a tube being fluidly coupled to said air chamber such that compressed air stored within said air chamber is released into said tube when said outlet valve is placed in said open position, said tube having an open free end, at least two guide bars being positioned within said tube and mounted generally adjacent to said free end;

a first popup pressure indicator being fluidly coupled to said air chamber, said first pop-up pressure indicator being positionable in a retracted position or an extended position, said first pop-up pressure indicator being urged into said extended position when compressed air positioned in said air chamber is generally equal to a first pressure; and a second pop-up pressure indicator being fluidly coupled to said air chamber, said second pop-up pressure indicator being positionable in a retracted position or an extended position, said second popup pressure indicator being urged into said extended position when compressed air positioned in said air chamber is at least 10 psi greater than said first pressure.

2. The compressed air plunger tool of claim 1, wherein said air chamber is elongated and has a first end a second end, said air inlet being positioned on said first end and said outlet valve being positioned generally adjacent to said second end, said tube being attached to said second end of said air chamber.

3. The compressed air plunger tool of claim 1, wherein said tube has a 180 degree bend therein such that a first portion and a second portion of said tube are defined, said first portion being attached to said air chamber, wherein a combined length of said first portion and said air chamber is shorter than a length of said second portion.

4. The compressed air plunger tool of claim 1, wherein said tube is threaded at a position adjacent to said free end, at least one adapter being selectively threadably coupled to said free end of said tube, said adapter having an threaded opening extending therethrough, said opening being threaded for selectively coupling to said threads on said tube.

5. The compressed air plunger tool of claim 4, wherein said adapter comprises an elastomeric material.

6. The compresses air plunger tool of claim 4, said adapter including a sleeve and being attached to a base of a frusto-conical section, said opening extending through said sleeve and said frusto-conical section, said sleeve being adapted for receiving said free end of said tube.

7. The compressed air plunger tool of claim 1, wherein said first pressure is greater than 50 psi.

8. The compressed air plunger tool of claim 1, wherein said first pressure is greater than 70 psi.

9. The compressed air plunger tool of claim 1, wherein said second pop-up pressure indicator includes an air outlet fluidly coupled to said air chamber, wherein said air outlet is opened to release compressed air outwardly of said air chamber when said second pop-up pressure indicator is in said extended position.

10. A compressed air plunger tool, said tool comprising:

an air chamber for releasably storing compressed air, said air chamber including an air inlet fluidly coupled thereto for selectively receiving compressed air, said air inlet comprising a one-way air inlet, an outlet valve being fluidly coupled to said air chamber, said outlet valve being selectively positioned in a closed position for retaining compressed air within said air chamber or an open position for releasing compressed air from said air chamber, said air chamber being elongated and having a first end a second end, said air inlet being positioned on said first end and said outlet valve being positioned generally adjacent to said second end;

a tube being fluidly coupled to said air chamber such that compressed air stored within said air chamber is released into said tube when said outlet valve is placed in said open position, said tube being attached to said second end of said air chamber, said tube having an open free and, said tube being threaded at a position adjacent to said free end, at least two guide bars being positioned within said tube and mounted generally adjacent to said free end, said tube having a 180 degree bend therein such that a first portion and a second portion of said tube are defined, said first portion being attached to said air chamber, wherein a combined length of said first portion and said air chamber is shorter than a length of said second portion;

a first pop-up pressure indicator being fluidly coupled to said air chambers said first pop-up pressure indicator being positionable in a retracted position or an extended position, said first popup pressure indicator being urged into said extended position when compressed air positioned in said air chamber is greater than 70 psi;

a second pop-up pressure indicator being fluidly coupled to said air chamber, said second pop-up pressure indicator being positionable in a retracted position or an extended position, said second pop-up pressure indicator being urged into said extended position when compressed air positioned in said air chamber is greater than 90 psi, said second pop-up pressure indicator including an air outlet fluidly coupled to said air chamber, wherein said air outlet is opened to release compressed air outwardly of said air chamber when said second pop-up pressure indicator is in said extended position; and at least one adapter being selectively threadably coupled to said free end of said tube, said adapter having an threaded opening extending therethrough, said opening being threaded for selectively coupling to said threads on said tube, said adapter comprising an elastomeric material, said adapter including a sleeve and being attached to a base of a frusto-conical section, said opening extending through said sleeve and said frusto-conical section, said sleeve being adapted for receiving said free end of said tube.

* * * * *